US011048193B1

(12) United States Patent
Kanai

(10) Patent No.: US 11,048,193 B1
(45) Date of Patent: Jun. 29, 2021

(54) PRESSURE DEVICE AND PRESSURE PROCESSING DEVICE USING THE SAME

(71) Applicant: FUJIFILM Business Innovation Corp., Tokyo (JP)

(72) Inventor: Kenji Kanai, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/914,473

(22) Filed: Jun. 29, 2020

(30) Foreign Application Priority Data

Mar. 27, 2020 (JP) ..... JP2020-058622

(51) Int. Cl.
*G03G 15/20* (2006.01)

(52) U.S. Cl.
CPC ..... *G03G 15/2032* (2013.01); *G03G 15/2064* (2013.01); *G03G 2215/2032* (2013.01); *G03G 2215/2035* (2013.01)

(58) Field of Classification Search
CPC ..... G03G 15/2032; G03G 15/2035
See application file for complete search history.

(56) References Cited

U.S. PATENT DOCUMENTS

2011/0069984 A1* 3/2011 Watanabe ..... G03G 15/2028 399/67
2018/0267448 A1* 9/2018 Kajita ..... G03G 15/2032

FOREIGN PATENT DOCUMENTS

JP 2013186304 9/2013

* cited by examiner

*Primary Examiner* — Victor Verbitsky
(74) *Attorney, Agent, or Firm* — JCIPRNET

(57) ABSTRACT

A pressure device includes: a first pressure element; a second pressure element that is disposed so as to oppose the first pressure element and that applies pressure to a medium nipped between the first pressure element and the second pressure element; a moving device that moves the second pressure element toward and away from the first pressure element, between a contact position and a retracted position; an urging member that urges the first pressure element toward the second pressure element when the second pressure element is located at the contact position; and a driving device that applies a driving force to the second pressure element, thus allowing the first pressure element to rotate in a driven manner when the second pressure element is located at the contact position. The moving device has a moving element that is provided on a side of the second pressure element opposite from a contact area between the first pressure element and the second pressure element and that moves the second pressure element toward the first pressure element. The driving device applies a driving force in a direction in which the second pressure element is urged toward the moving element.

20 Claims, 9 Drawing Sheets

PRESSURE DEVICE AND PRESSURE PROCESSING DEVICE USING THE SAME

CROSS-REFERENCE TO RELATED APPLICATIONS

This application is based on and claims priority under 35 USC 119 from Japanese Patent Application No. 2020-058622 filed Mar. 27, 2020.

BACKGROUND

(i) Technical Field

The present disclosure relates to a pressure device and a pressure processing device using the same.

(ii) Related Art

A known pressure device is disclosed in Japanese Unexamined Patent Application Publication No. 2013-186304 (Detailed Description and FIG. 4).

Japanese Unexamined Patent Application Publication No. 2013-186304 discloses a fixing device including: a heating part having an endless belt, a heating source for heating the endless belt, and an applying member to be applied to the inner surface of the endless belt; and a pressure part having a roller member disposed so as to oppose the endless belt to allow a medium to pass between the roller member and the endless belt, a pressure mechanism that applies pressure to the roller member, and a moving mechanism that moves the roller member to change the pressing force distribution in a nip area where the medium is nipped.

SUMMARY

Aspects of non-limiting embodiments of the present disclosure relate to providing a pressure device having a pair of pressure elements that can move toward and away from each other, in which contact-pressure-distribution variation is reduced in a contact area between the pair of pressure elements even if a reaction force is generated in the pressure elements when the pressure elements are driven in a contact manner, and providing a pressure processing device using the same.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a pressure device including: a first pressure element; a second pressure element that is disposed so as to oppose the first pressure element and that applies pressure to a medium nipped between the first pressure element and the second pressure element; a moving device that moves the second pressure element toward and away from the first pressure element, between a contact position and a retracted position; an urging member that urges the first pressure element toward the second pressure element when the second pressure element is located at the contact position; and a driving device that applies a driving force to the second pressure element, thus allowing the first pressure element to rotate in a driven manner when the second pressure element is located at the contact position. The moving device has a moving element that is provided on a side of the second pressure element opposite from a contact area between the first pressure element and the second pressure element and that moves the second pressure element toward the first pressure element. The driving device applies a driving force in a direction in which the second pressure element is urged toward the moving element.

BRIEF DESCRIPTION OF THE DRAWINGS

Exemplary embodiments of the present disclosure will be described in detail based on the following figures, wherein.

DETAILED DESCRIPTION

Outline of Exemplary Embodiment

Figure 1B:
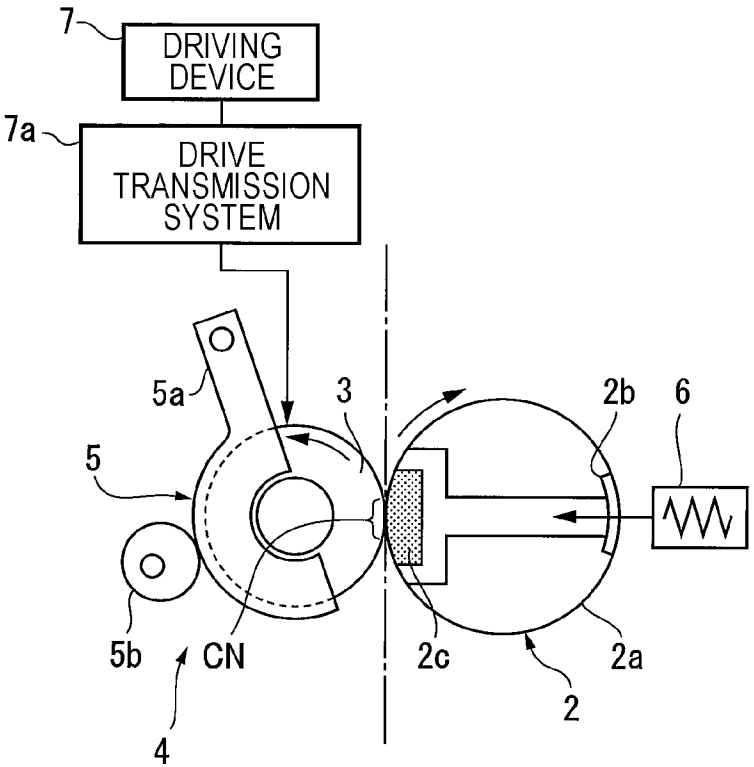
FIG. 1B shows the relevant part of a pressure device used in the pressure processing device in FIG. 1A.
Figure 1A:
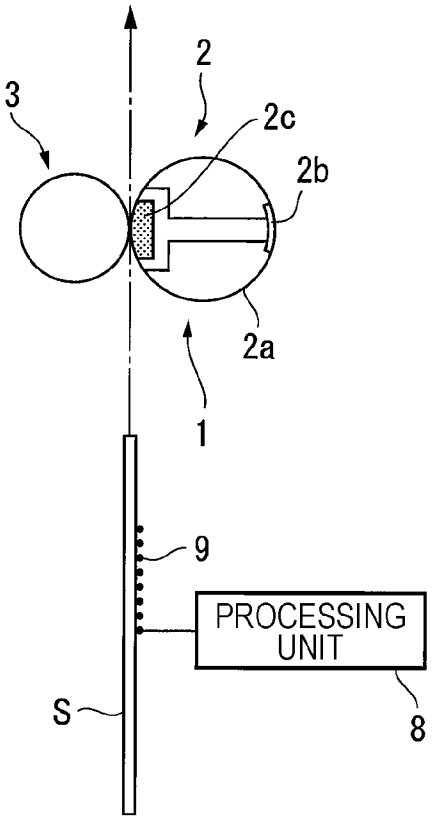
FIG. 1A shows the outline of an exemplary embodiment of a pressure processing device of the present disclosure.

FIG. 1A shows the outline of an exemplary embodiment of a pressure processing device of the present disclosure.

In FIG. 1A, the pressure processing device includes a processing unit 8 that applies a pressure-receiving object 9 onto a medium S, and a pressure device 1 that applies pressure to the pressure-receiving object 9 on the medium S.

As shown in FIG. 1B, the pressure device 1 includes: a first pressure element 2; a second pressure element 3 that is disposed so as to oppose the first pressure element 2 and applies pressure to the medium S nipped between the first pressure element 2 and the second pressure element 3; a moving device 4 that moves the second pressure element 3 toward and away from the first pressure element 2, between a contact position and a retracted position; an urging member 6 that urges the first pressure element 2 toward the second pressure element 3 when the second pressure element 3 is located at the contact position; and a driving device 7 that applies a driving force to the second pressure element 3 to allow the first pressure element 2 to rotate in a driven manner when the second pressure element 3 is located at the contact position. The moving device 4 includes a moving element 5 that is provided on a side of the second pressure element 3 opposite from a contact area CN between the first pressure element 2 and the second pressure element 3 and that moves the second pressure element 3 toward the first pressure element 2. The driving device 7 applies a driving force in a direction in which the second pressure element 3 is urged toward the moving element 5.

The pair of pressure elements 2 and 3 does not necessarily have to be a combination of an endless belt member and a roller member, and may be a combination of roller members.

The moving device 4 has the moving element 5 that moves the second pressure element 3 toward and away from the first pressure element 2.

The urging member 6 is necessary in maintaining the contact pressure at the contact area CN between the first pressure element 2 and the second pressure element 3. The urging member 6 urges the first pressure element 2, not the second pressure element 3.

The driving device 7 applies a driving force to the second pressure element 3 such that the second pressure element 3 is pressed against the moving element 5. As a result, it is possible to prevent a reaction force from acting on the contact area CN between the first pressure element 2 and the second pressure element 3.

Next, typical and desirable aspects of the pressure device according to this exemplary embodiment will be described.

The first pressure element 2 is heated by a heating source 2*b*. In this example, the device applies pressure while applying heat. The heating source 2*b* does not necessarily have to be provided in the first pressure element 2 and may be provided in the second pressure element 3.

Furthermore, when the first pressure element 2 has a large number of attachments and has the heating source 2*b*, an endless belt member 2*a* is heated by the heating source 2*b*, and an opposing member 2*c* is disposed on the back of the belt member 2*a* opposed to the second pressure element 3.

Furthermore, from the standpoint of reducing the installation space for the urging member 6, it is desirable that the urging member 6 apply an elastic urging force produced by compressive deformation to the first pressure element 2.

Furthermore, to reduce the urging force applied by the urging member 6, it is desirable to make the first pressure element 2 retractable by an amount smaller than the amount by which the second pressure element 3 is moved.

In the moving device 4, the moving element 5 includes: a pivot member 5*a* that is pivotable about a pivot support and acts on a supported portion of the second pressure element 3 to move the second pressure element 3 toward and away from the first pressure element 2; and a displacement member 5*b* that displaces the pivot member 5*a* so as to pivot within a predetermined area.

In this example, the pivot member 5*a* may be formed of one functional member or may be formed by connecting, via a spring member, two functional members that are pivotable about a common pivot support or different pivot supports; that is, the design may be changed as appropriate. The displacement member 5*b* is typically an eccentric rotation member (cam member). It is desirable that the pivot member 5*a* have a cam follower at a contact portion with respect to the eccentric rotation member (cam member), from the standpoint of reducing the contact resistance with respect to the pivot member 5*a*.

The point at which the driving force from the driving device 7 is applied to the second pressure element 3 (the driving-force application point) is located upstream of the support point at which the second pressure element 3 is supported by the moving element 5 of the moving device 4 in the rotation direction of the second pressure element 3 and downstream of the contact area CN between the first pressure element 2 and the second pressure element 3 in the rotation direction of the second pressure element 3.

It is desirable that the driving device 7 have a drive transmission system 7*a* (for example, a drive transmission gear train) that applies a driving force in the direction in which the second pressure element 3 moves away from the contact area CN at the driving-force application point to the second pressure element 3.

It is more desirable that the moving element 5 have the pivot member 5*a* that is pivotable about the pivot support and acts on the supported portion of the second pressure element 3 to move the second pressure element 3 toward and away from the first pressure element 2, and that the pivot support of the pivot member 5*a* be coaxial with a drive support of the driving device 7. This configuration is desirable because the installation spaces for the moving device 4 and the driving device 7 can be partially shared.

The present disclosure will be described in more detail below based on the exemplary embodiments illustrated in the attached drawings.

First Exemplary Embodiment

Overall Configuration of Image Forming Apparatus

Figure 2:
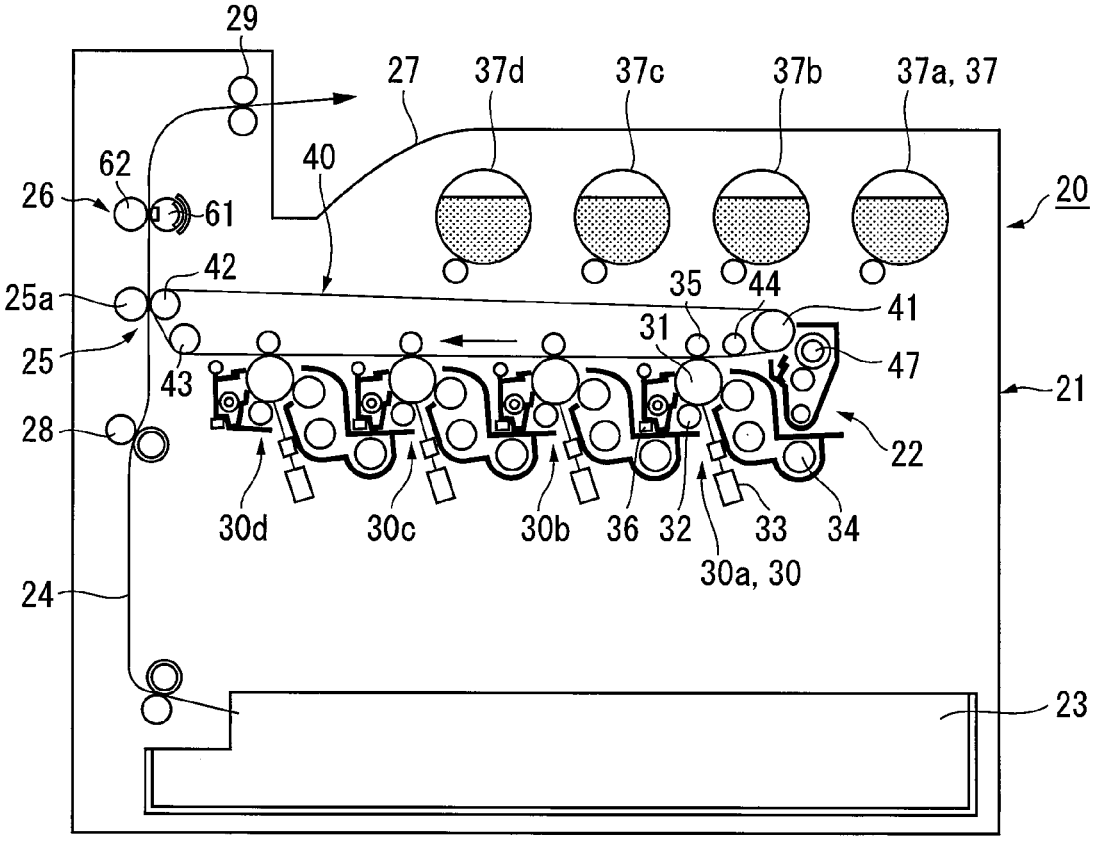
FIG. 2 shows an example of an image forming apparatus serving as the pressure processing device according to a first exemplary embodiment.

FIG. 2 shows the overall configuration of an image forming apparatus, serving as a pressure processing device according to the first exemplary embodiment.

In FIG. 2, an image forming apparatus 20 includes: an apparatus housing 21; an image-forming engine 22 for forming, for example, multiple color component images; and a sheet supply container 23 (in this example, a single-drawer structure) provided below the image-forming engine 22 to supply sheets, serving as media. A sheet supplied from the sheet supply container 23 is transported along a sheet transport path 24 extending substantially in the vertical direction, and images formed in the image-forming engine 22 are transferred by a simultaneous transfer device 25. The image transferred to the sheet is fixed by a fixing device 26, serving as an example of the pressure device, and the sheet having the image fixed thereto is discharged on a sheet output tray 27 provided, for example, at the top of the apparatus housing 21.

Image-Forming Engine

In this example, the image-forming engine 22 includes multiple image forming units 30 (30*a* to 30*d*) that form color component images with toners (in this example, yellow (Y), magenta (M), cyan (C), and black (K)) using an electrophotographic system. The color component images formed by the image forming units 30 are first-transferred to an intermediate transfer body 40, and the images on the intermediate transfer body 40 are simultaneously transferred (second-transferred) to a sheet by the simultaneous transfer device 25.

In this example, the image forming units 30 (30*a* to 30*d*) each include, for example: a drum-shaped photoconductor 31; a charging device 32 that charges the photoconductor 31; a latent-image writing device 33 that forms an electrostatic latent image on the charged photoconductor 31; a developing device 34 that develops the electrostatic latent image formed on the photoconductor 31 with the corresponding color component toner; a first transfer device 35 disposed on the back surface of the intermediate transfer body 40 so as to oppose the photoconductor 31 to first-transfer the image on the photoconductor 31 to the intermediate transfer body 40; and a cleaning device 36 that removes the toner remaining on the photoconductor 31 after the first transfer.

Although the latent-image writing device 33 in this example individually writes a latent image on the corresponding image forming unit 30 by using, for example, an LED array, it is also possible to provide a common laser scanning device that writes the respective color-component electrostatic latent images on the respective image forming units 30 using the corresponding laser light or to provide separate laser scanning devices. Toner cartridges 37 (37*a* to 37*d*) supply color component toners to the developing devices 34 of the respective image forming units 30 (30*a* to 30*d*).

Furthermore, the intermediate transfer body 40 in this example is formed of a belt-like member stretched over multiple belt rollers 41 to 44 and is rotationally driven in a predetermined direction by the belt roller 41, serving as a driving roller. The belt roller 43 serves as a tension roller that applies desired tension to the intermediate transfer body 40.

An intermediate-transfer-body cleaning device 47 removes residue (toner, paper dust, etc.) on the intermediate transfer body 40.

Furthermore, in this example, the simultaneous transfer device 25 includes a transfer roller 25*a* that is in contact with the surface of the intermediate transfer body 40 so as to be rotated in a driven manner. By forming a desired transfer electric field between the transfer roller 25*a* and the belt roller 42 supporting the intermediate transfer body 40, the images on the intermediate transfer body 40 are simultaneously transferred to the sheet.

A registration roller 28 for positioning the sheet to be fed to the simultaneous transfer device 25 is provided upstream of the simultaneous transfer device 25 in the sheet transport path 24, and a discharging roller 29 is provided immediately before the sheet output tray 27 in the sheet transport path 24.

Overall Configuration of Fixing Device

In the fixing device 26 according to this exemplary embodiment, the first pressure element 2 has a heating function. A sheet with an unfixed image is nipped between the first pressure element 2 and the second pressure element 3, and heat and pressure are applied to the unfixed image to fix the image.

Figure 3:
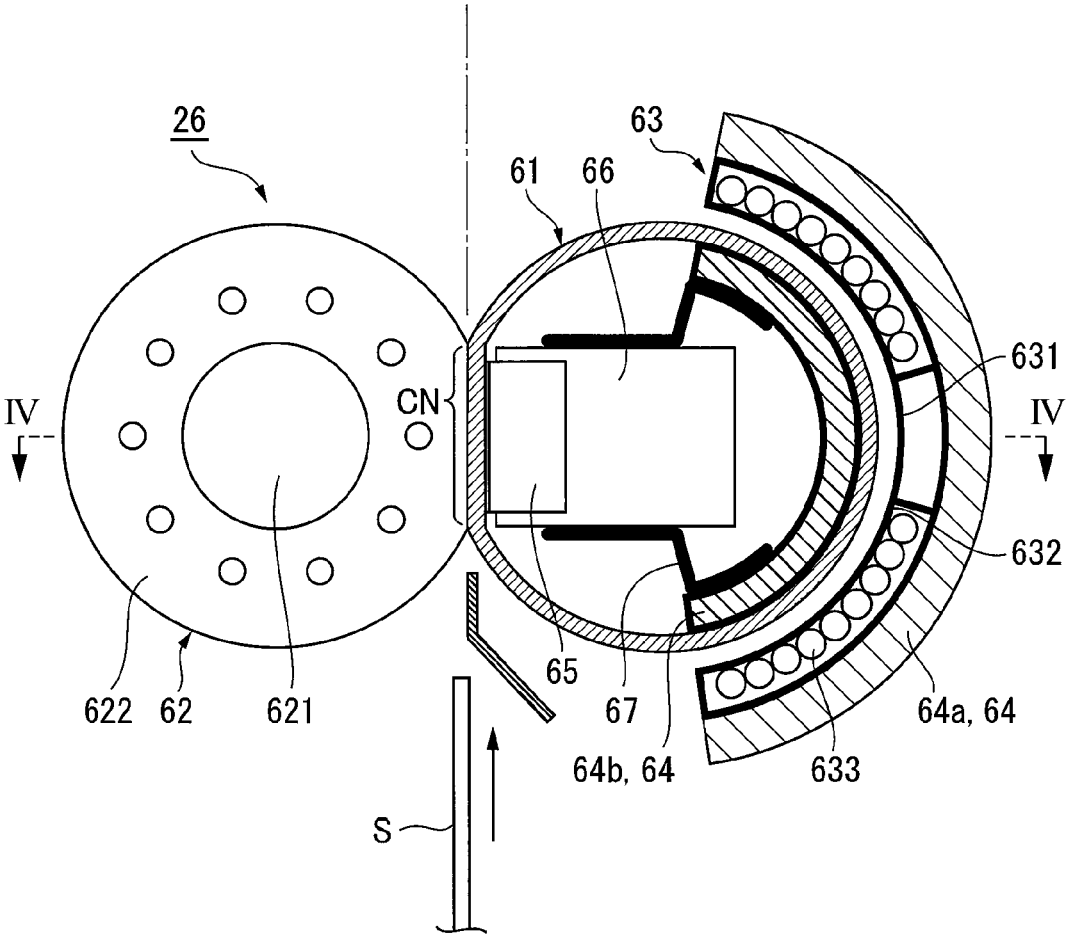
FIG. 3 shows an example of a fixing device serving as the pressure device used in the first exemplary embodiment.

As shown in FIGS. 2 and 3, the first pressure element 2 in this example operates on, for example, a so-called induction heating system and includes: a heat-fixing belt 61 having a heat-generating layer that generates heat by the effect of a magnetic field; a magnetic-field generator 63 that is disposed at a predetermined distance from the outer circumferential surface of the heat-fixing belt 61 and that generates a magnetic field to cause the heat-fixing belt 61 to generate heat; and a pressing pad 65 that is disposed on the back of the heat-fixing belt 61, at a portion opposed to the second pressure element 3, and that presses the heat-fixing belt 61 toward the second pressure element 3.

As shown in FIGS. 2 and 3, the second pressure element 3 includes a pressure-fixing roller 62 that is disposed so as to oppose a portion of the heat-fixing belt 61 corresponding to the pressing pad 65 and that transports the sheet nipped between the pressure-fixing roller 62 and the heat-fixing belt 61.

Fixing Heating Belt and Fixing Pressure Roller

In this example, the heat-fixing belt 61 includes an endless belt member having a larger width than at least the width of the sheet. The belt member has multiple layers including, for example: a base layer; a conducting layer (functioning as a heat-generating layer) made of, for example, a non-magnetic metal; an elastic layer; a surface layer; and the like.

The pressure-fixing roller 62 includes a rotary shaft 621 and an elastic roller body 622 provided around the rotary shaft 621.

Magnetic-Field Generator

In this example, the magnetic-field generator 63 includes a base 631 surrounding substantially a half of the outer circumferential surface of the heat-fixing belt 61, the half being located opposite from the pressure-fixing roller 62. The base 631 extends in the width direction of the heat-fixing belt 61 and has an arc-shaped section. The base 631 has a coil receiving portion 632 extending in the width direction of the heat-fixing belt 61, and a magnetizing coil 633 having a winding structure is held in the coil receiving portion 632.

Furthermore, in this example, magnetic-field trapping members 64 (64*a* and 64*b*) are provided on the outside of the magnetic-field generator 63 (more specifically, at a portion of the base 631 on the back of the magnetizing coil 633, the portion being opposite from the heat-fixing belt 61) and on the inside of the heat-fixing belt 61, at a portion facing the magnetic-field generator 63, respectively. The magnetic-field trapping members 64 (64*a* and 64*b*) are made of a magnetic material (for example, ferrite) and have a substantially arc-shaped section conforming to the shape of the base 631. By sandwiching the heat-fixing belt 61 from the outside and the inside with the magnetic-field trapping members 64, the magnetic field generated by the magnetizing coil 633 is trapped, thus forming a desired magnetic path and improving the heating efficiency of the electromagnetic induction.

Structure around Pressing Pad

A pad support member 66 that supports the pressing pad 65 is disposed inside the heat-fixing belt 61 opposed to the pressure-fixing roller 62. The pad support member 66 has the shape of a rod extending in the width direction of the heat-fixing belt 61 and supports the pressing pad 65 at a portion facing the pressure-fixing roller 62. By pressing the heat-fixing belt 61 against the pressure-fixing roller 62, the sheet S is nipped at a predetermined contact area CN between the pressure-fixing roller 62 and the heat-fixing belt 61 and is transported, and the image on the sheet S is fixed.

In this example, a support bracket 67 is provided on the pad support member 66 to support the magnetic-field trapping member 64 (64*b*) located inside the heat-fixing belt 61.

Support Structure in Fixing Device

Support Structure for Heat-Fixing Belt

Figure 4:
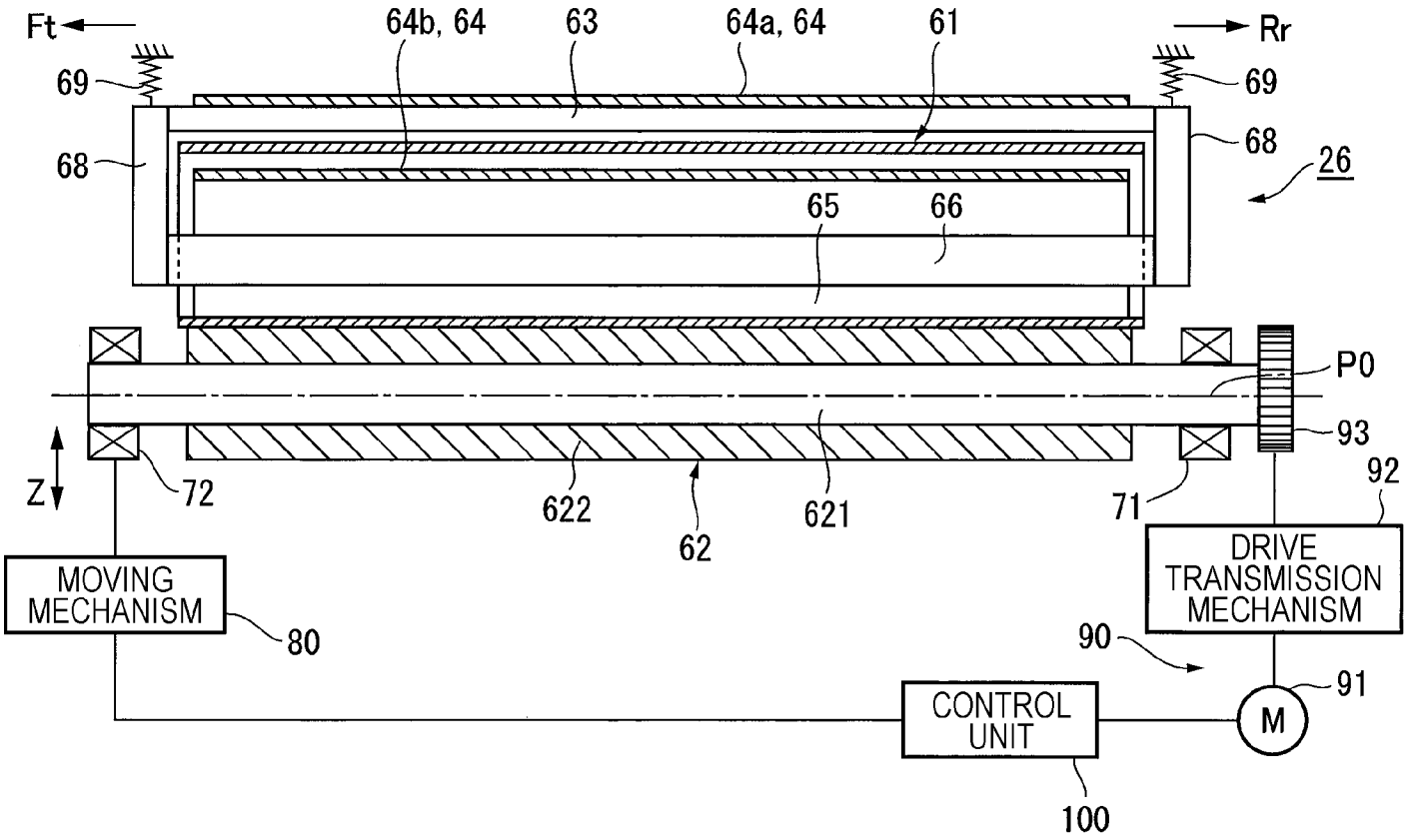
FIG. 4 is a sectional view taken along line IV-IV in FIG. 3.

In this exemplary embodiment, as shown in FIG. 4, in the support structure for the heat-fixing belt 61, the pad support member 66 and the magnetic-field generator 63 are held by a pair of holders 68 at both ends in the width direction intersecting the moving direction of the heat-fixing belt 61 and are integrated as the first pressure element 2.

Figure 5:
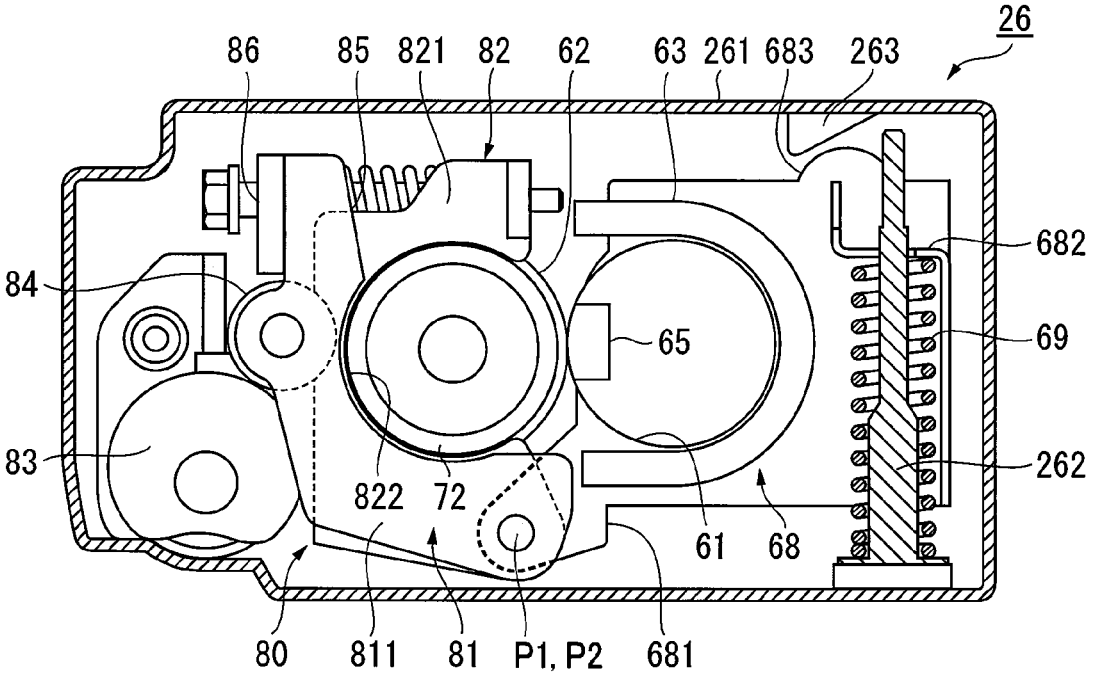
FIG. 5 shows the relevant part of a moving mechanism of the fixing device according to the first exemplary embodiment.

In this example, as shown in FIGS. 4 and 5, the holders 68 have holder arms 681 that are pivotable about predetermined supports P1, serving as pivot supports. The heat-fixing belt 61 is urged toward the pressure-fixing roller 62 by urging springs 69 and can be retracted from a predetermined initial position.

The respective components of the fixing device 26 are accommodated in a fixing housing 261. Retention pins 262 are fixed to, for example, portions of the fixing housing 261. The urging springs 69 are positioned with respect to the retention pins 262. First ends of the urging springs 69 are engaged with the base ends of the retention pins 262, and second ends of the compressed urging springs 69 are engaged with hook portions 682 formed on the holder arms 681. With this structure, the holder arms 681 are urged in the counterclockwise direction in FIG. 5 about the supports P1, serving as the pivot supports, by the elastic restoring force of the urging springs 69, and stopper projections 683 formed on the holder arms 681 are brought into contact with stopper walls 263 formed on the fixing housing 261. In this way, the initial position of the heat-fixing belt 61 is set.

In this example, as shown in FIG. 5, the supports P1 are located in an area between the contact area CN between the heat-fixing belt 61 and the pressure-fixing roller 62 and the axis of the rotary shaft 621 of the pressure-fixing roller 62, the area being on a sheet-entering side.

Support Structure for Pressure-Fixing Roller

As shown in FIG. 4, in the pressure-fixing roller 62, both ends of the rotary shaft 621 of the roller body 622 are rotatably supported by bearing members 71 and 72.

In this example, the bearing member 71 on the rear side (denoted by "Rr" in FIG. 4) of the apparatus housing 21 is provided at a predetermined position, and the bearing member 72 on the front side (denoted by "Ft" in FIG. 4) of the apparatus housing 21 is movably supported by a moving mechanism 80.

Herein, the moving mechanism 80 moves a portion of the pressure-fixing roller 62 supported by the other bearing member 72 in a direction (in the arrow Z direction corresponding to the vertical direction in FIG. 4) intersecting the rotary shaft direction about a pivot support P0, where the pressure-fixing roller 62 is supported by one bearing member 71, thus moving the pressure-fixing roller 62 toward and away from the heat-fixing belt 61, between the contact position, where the pressure-fixing roller 62 is in contact with the heat-fixing belt 61 located at the initial position, and the retracted position, where the pressure-fixing roller 62 is retracted from the contact position.

In this example, when, for example, a paper jam occurs at the contact area CN in the fixing device 26, the moving mechanism 80 may release the contact state between the heat-fixing belt 61 and the pressure-fixing roller 62 to enable a jam eliminating operation. In addition, for example, when the fixing device 26 is started, the moving mechanism 80 temporarily retracts the pressure-fixing roller 62 to the retracted position from the heat-fixing belt 61 to eliminate heat conduction to the pressure-fixing roller 62 so that the heat-fixing belt 61 alone is efficiently heated.

Details of the moving mechanism 80 will be described below.

Driving System in Fixing Device

As shown in FIG. 4, in the fixing device 26 in this example, a driving mechanism 90 is connected to the rear end of the rotary shaft 621 of the pressure-fixing roller 62.

Herein, in the driving mechanism 90, a driven transmission gear 93 is coaxially connected to the end of the rotary shaft 621 of the pressure-fixing roller 62, and the driving force from the driving motor 91 is transmitted to the driven transmission gear 93 via a drive transmission mechanism 92 including a predetermined drive transmission gear train.

In this example, the driving mechanism 90 rotationally drives the pressure-fixing roller 62 and allows the heat-fixing belt 61, which is in contact with the pressure-fixing roller 62 in a state in which the pressure-fixing roller 62 is disposed at the contact position by the moving mechanism 80, to be rotated in a driven manner.

Control System in Fixing Device

As shown in FIG. 4, in this example, a control unit 100 is connected to the fixing device 26. The control unit 100 is formed of a microcomputer including, for example: a processor, such as a CPU; a read-only memory (ROM); a random-access memory (RAM); and an input/output (I/O) port and transmits a control signal to the moving mechanism 80 and the driving mechanism 90 according to an image-forming program preliminarily installed in the processor to control the moving operation of the moving mechanism 80 and the driving operation of the driving mechanism 90.

The timing when the driving mechanism 90 starts to drive the pressure-fixing roller 62 may be selected as appropriate; it may be either after the pressure-fixing roller 62 is moved to the contact position by the moving mechanism 80 or before the pressure-fixing roller 62 reaches the contact position.

A temperature sensor (not shown), serving as a temperature control system in the fixing device 26, is disposed at an appropriate position on the inner circumferential surface of the heat-fixing belt 61 in a contact or non-contact manner. The temperature sensor detects the temperature of the heat-fixing belt 61, and the control unit 100 controls generation of a magnetic field by the magnetic-field generator 63 on the basis of the information obtained by the temperature sensor to control the temperature of the heat-fixing belt 61.

Configuration Example of Moving Mechanism

FIG. 5 shows a configuration example of the moving mechanism 80 assembled in the fixing device 26.

In FIG. 5, the moving mechanism 80 includes a first support arm 81 that pivots about a predetermined support P2 (in this example, the support P2 is coaxial with the supports P1 of the holder arms 681) and a second support arm 82 that also pivots about the support P2.

In this example, the first support arm 81 includes an arm member 811 extending from the support P2 and surrounding, in a substantially L shape, a circumferential portion of the bearing member 72 for the pressure-fixing roller 62, the circumferential portion being located opposite from the contact area CN between the heat-fixing belt 61 and the pressure-fixing roller 62. A cam member 83, serving as an eccentric rotation member, is disposed on a portion of the arm member 811 opposite from the bearing member 72, and a cam follower 84, which is, for example, a roller, is provided on a portion of the arm member 811 corresponding to the cam member 83.

The second support arm 82 includes an arm member 821 extending from the support P2 toward the opposite side of the contact area CN between the heat-fixing belt 61 and the pressure-fixing roller 62 so as to surround, in a substantially C shape, a circumferential portion of the bearing member 72 for the pressure-fixing roller 62. The arm member 821 has a recess 822 surrounding the bearing member 72, on the side closer to the bearing member 72. A compressed nip spring 85 is disposed between a bent end of the arm member 821 and a bent end of the arm member 811 of the first support arm 81. The bent ends of the arm members 811 and 821 are connected to each other by a nip screw 86 to hold the nip spring 85 in place and to restrict the maximum span between the bent ends of the arm members 811 and 821.

Setting of Driving-Force Application Point by Driving Mechanism

Figure 6:
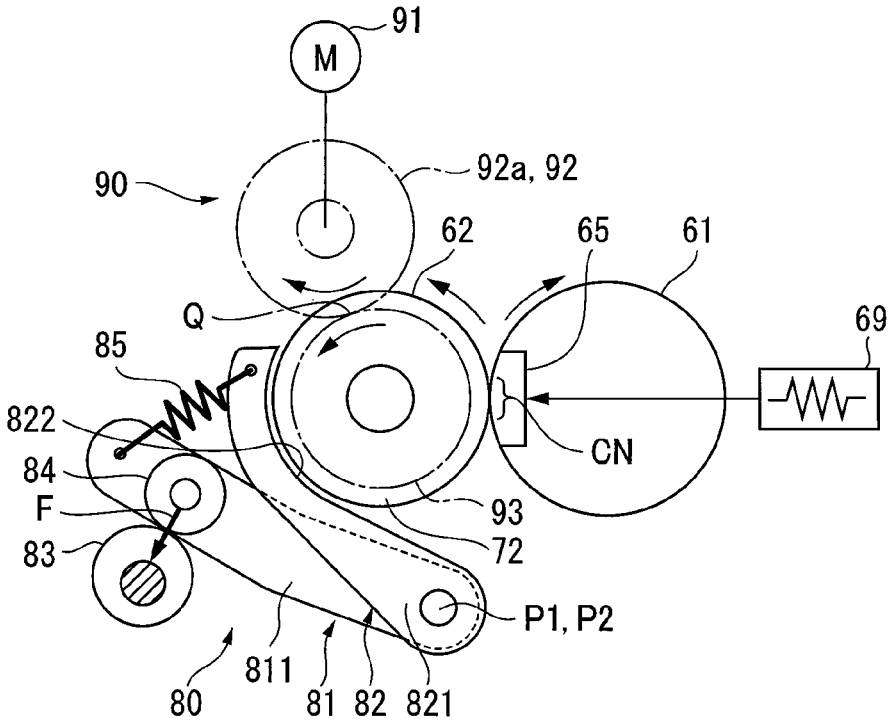
FIG. 6 shows an example of a driving mechanism of the fixing device according to the first exemplary embodiment.

As shown in FIG. 6, in the driving mechanism 90 in this example, the driving force of the driving motor 91 is transmitted to the driven transmission gear 93 of the pressure-fixing roller 62 via the drive transmission mechanism 92. A mesh position Q between a drive transmission gear 92*a*, which is located at the final stage of the drive transmission mechanism 92, and the driven transmission gear 93 is set at a position downstream of the contact area CN between the heat-fixing belt 61 and the pressure-fixing roller 62 in the rotation direction of the pressure-fixing roller 62 and upstream of the contact portion between the bearing member 72 and the recess 822 in the second support arm 82 of the moving mechanism 80 in the rotation direction of the pressure-fixing roller 62.

FIG. 6 schematically shows the relevant part of the moving mechanism 80 shown in FIG. 5.

Operation of Fixing Device

Moving Operation in Fixing Device

First, the moving operation in the fixing device 26 will be described.

When the fixing device 26 is to be driven, the pressure-fixing roller 62 has to be moved to the contact position, where the pressure-fixing roller 62 is in contact with the heat-fixing belt 61, to form the contact area CN having a predetermined contact pressure between the heat-fixing belt 61 and the pressure-fixing roller 62.

At this time, as shown in FIGS. 5 and 6, in the moving mechanism 80, the cam member 83 is rotated by a driving motor (not shown) in a direction in which the distance between the center of the cam member 83 and the cam follower 84 increases and is stopped when a predetermined distance is reached. In this state, the first support arm 81 is pivoted by the cam member 83, via the cam follower 84, about the support P2 toward the heat-fixing belt 61. As a result, the pivot end of the first support arm 81 presses the nip spring 85 in a direction in which the nip spring 85 is compressed, and the nip spring 85 presses the pivot end of the second support arm 82. In this case, because the second support arm 82 presses the bearing member 72 toward the heat-fixing belt 61 with the arm member 821 fitted in the recess 822, the end of the pressure-fixing roller 62 supported by the bearing member 72 is pivoted about the end supported by the bearing member 71 and is disposed at the contact position, forming the contact area CN between the pressure-fixing roller 62 and the heat-fixing belt 61. At this time, the pressure-fixing roller 62 is disposed at the predetermined contact position and is in contact with the heat-fixing belt 61 urged by the urging springs 69. Hence, the nip load produced by the urging force of the urging springs 69 acts in the contact area CN.

When a sheet S having an unfixed image passes through the contact area CN between the heat-fixing belt 61 and the pressure-fixing roller 62 under the condition in which the heat-fixing belt 61 has been heated to a necessary temperature for fixing processing, the unfixed image on the sheet S is heated and pressed and thus is fixed to the sheet S.

When, for example, a paper jam occurs at the contact area CN in the fixing device 26, the contact state (nip state) between the heat-fixing belt 61 and the pressure-fixing roller 62 needs to be released.

At this time, in the moving mechanism 80, a driving motor (not shown) rotates the cam member 83 in a direction in which the distance between the center of the cam member 83 and the cam follower 84 decreases and stops when a predetermined distance is reached. In this state, the first support arm 81 is pressed toward the cam member 83 by the elastic restoring force of the nip spring 85 disposed between the first support arm 81 and the second support arm 82. As a result, the second support arm 82 is also pulled toward the cam member 83, moving the bearing member 72 surrounded by the second support arm 82 in a direction away from the heat-fixing belt 61, and moving the pressure-fixing roller 62 to the predetermined retracted position. Because the maximum length of the nip spring 85 is restricted by the nip screw 86, the nip spring 85 does not extend beyond a predetermined length.

Driving Operation in Fixing Device

In this exemplary embodiment, as shown in FIG. 6, the driving-force application point (corresponding to the mesh position Q) by the driving mechanism 90 is set at a position downstream of the contact area CN between the heat-fixing belt 61 and the pressure-fixing roller 62 in the rotation direction of the pressure-fixing roller 62 and upstream of the contact portion between the bearing member 72 and the recess 822 in the second support arm 82 of the moving mechanism 80 in the rotation direction of the pressure-fixing roller 62. In this state, a reaction force F caused by the application of driving force by the driving mechanism 90 acts on the moving mechanism 80. In this example, the cam member 83 receives the reaction force F. Therefore, in this example, not the reaction force F, but the nip load produced by the urging springs 69 alone, is applied to the contact area CN between the heat-fixing belt 61 and the pressure-fixing roller 62. Hence, the nip load at the contact area CN is balanced between the driven side and the opposite side of the pressure-fixing roller 62 and is stable over the entire contact area CN in the longitudinal direction.

In this exemplary embodiment, the moving mechanism 80 moves the pressure-fixing roller 62 toward and away from the heat-fixing belt 61. Hence, compared with a system in which the heat-fixing belt 61 is moved toward and away from the pressure-fixing roller 62 (first comparison example), a large moving distance can be easily ensured.

In this exemplary embodiment, because the urging springs 69 are compressed only by an amount allowing the heat-fixing belt 61 to move from the initial position to the nip position, the nip load at the contact area CN can be controlled to a certain low level, and thus, the torque when the pressure-fixing roller 62 is driven can be controlled to a low level.

Although the heat-fixing belt 61 has a large number of attachments in this exemplary embodiment, because the heat-fixing belt 61 is not moved toward and away from the pressure-fixing roller 62, the risk of applying large impacts on the attachments of the heat-fixing belt 61 by moving the heat-fixing belt 61 is small.

First Modification

Figure 7:
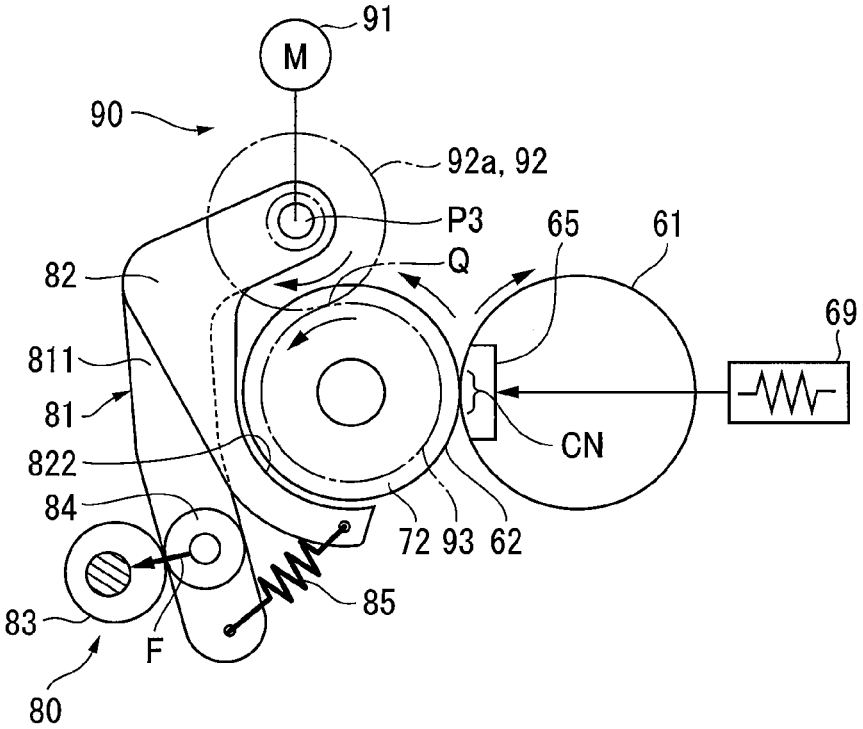
FIG. 7 shows a first modification of the fixing device according to the first exemplary embodiment.

FIG. 7 shows the relevant part of the fixing device 26 according to a first modification.

The basic structure of the fixing device 26 in FIG. 7 is substantially the same as that according to the first exemplary embodiment, except for the position of the pivot support of the first support arm 81 and the second support arm 82. The same components as those in the first exemplary embodiment will be denoted by the same reference signs, and detailed descriptions thereof will be omitted.

In this example, the basic structure of the driving mechanism 90 is substantially the same as that according to the first exemplary embodiment, and the mesh position Q between the drive transmission gear 92*a*, which is located at the final stage of the drive transmission mechanism 92, and the driven transmission gear 93 is set at a position downstream of the contact area CN between the heat-fixing belt 61 and the pressure-fixing roller 62 in the rotation direction of the pressure-fixing roller 62 and upstream of the contact portion between the bearing member 72 and the recess 822 in the second support arm 82 of the moving mechanism 80 in the rotation direction of the pressure-fixing roller 62.

Herein, the drive transmission gear 92*a* rotates about a pinned support P3, and the pivot support of the first support arm 81 and the second support arm 82 is coaxial with the pinned support P3 of the drive transmission gear 92*a*.

In this example, by making the pivot support of the first support arm 81 and the second support arm 82 of the moving mechanism 80 coaxial with the pinned support P3 of the drive transmission gear 92*a* of the driving mechanism 90, the components of the moving mechanism 80 and the driving mechanism 90 are arranged in a small space, compared with a configuration in which the components are provided at different positions.

Although omitted from the illustration, it is also possible to make the supports P1 of the holder arms 681 of the heat-fixing belt 61 coaxial with the pinned support P3 of the drive transmission gear 92*a*.

Second Modification

Figure 8:
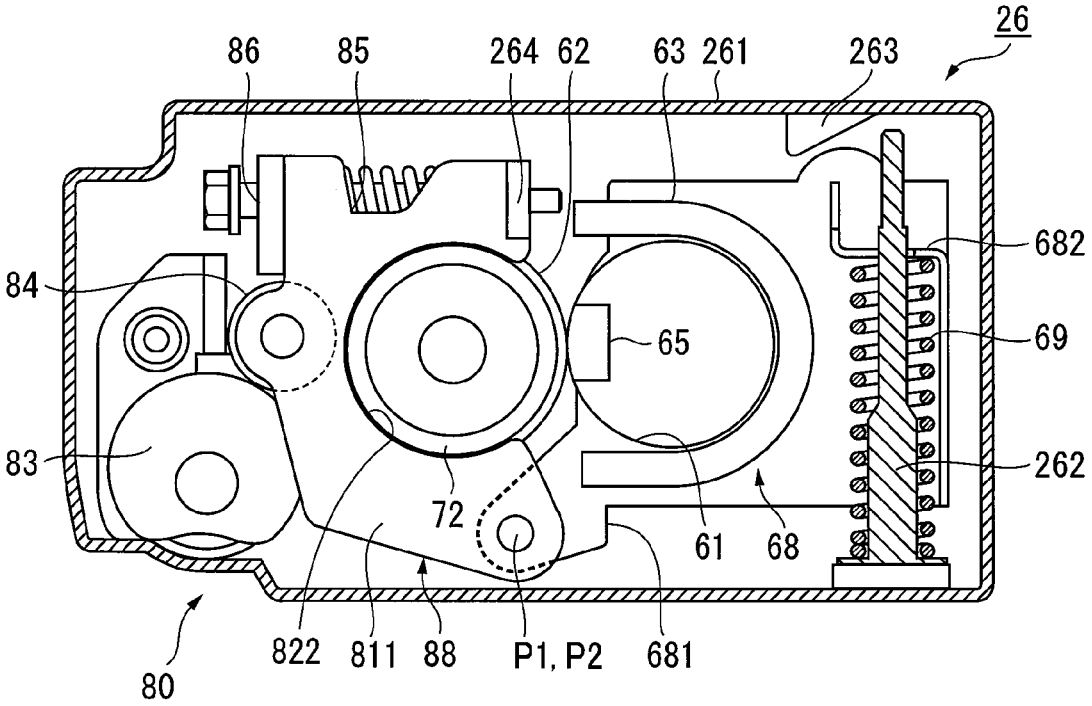
FIG. 8 shows a second modification of the fixing device according to the first exemplary embodiment.

FIG. 8 shows the relevant part of the fixing device 26 according to a second modification.

In FIG. 8, the basic structure of the fixing device 26 is substantially the same as that according to the first exemplary embodiment, except for the moving mechanism 80. The same components as those in the first exemplary embodiment will be denoted by the same reference signs, and detailed descriptions thereof will be omitted.

In FIG. 8, the moving mechanism 80 has one support arm 88, instead of the two support arms (the first support arm 81 and the second support arm 82).

In this example, the support arm 88 includes an arm member 881 extending from the support P2 toward the opposite side of the contact area CN between the heat-fixing belt 61 and the pressure-fixing roller 62 so as to surround, in a substantially C shape, a circumferential portion of the bearing member 72 for the pressure-fixing roller 62. The cam member 83 is disposed on a portion of the arm member 881 opposite from the bearing member 72, and the cam follower 84, which is, for example, a roller, is provided on a portion of the arm member 881 corresponding to the cam member 83.

Furthermore, the arm member 881 has a recess 882, which surrounds the bearing member 72, on the side closer to the bearing member 72. A compressed nip spring 85 is disposed between the bent end of the arm member 881 and a portion 264 of the fixing housing 261. The bent end of the arm member 881 and the portion 264 of the fixing housing 261 are connected by a nip screw 86, thus holding the nip spring 85 in place and restricting the maximum span between the bent end of the arm member 881 and the portion 264 of the fixing housing 261.

In this example, the urging force of the nip spring 85 applied to the support arm 88 is greater than that in the moving mechanism 80 according to the first exemplary embodiment. Other basic effects are substantially the same as those according to the first exemplary embodiment.

To evaluate the performance of the fixing device 26 according to the first exemplary embodiment, the fixing device 26 according to the first exemplary embodiment will be compared with fixing devices according to first and second comparison examples.

First Comparison Example

Figure 9:
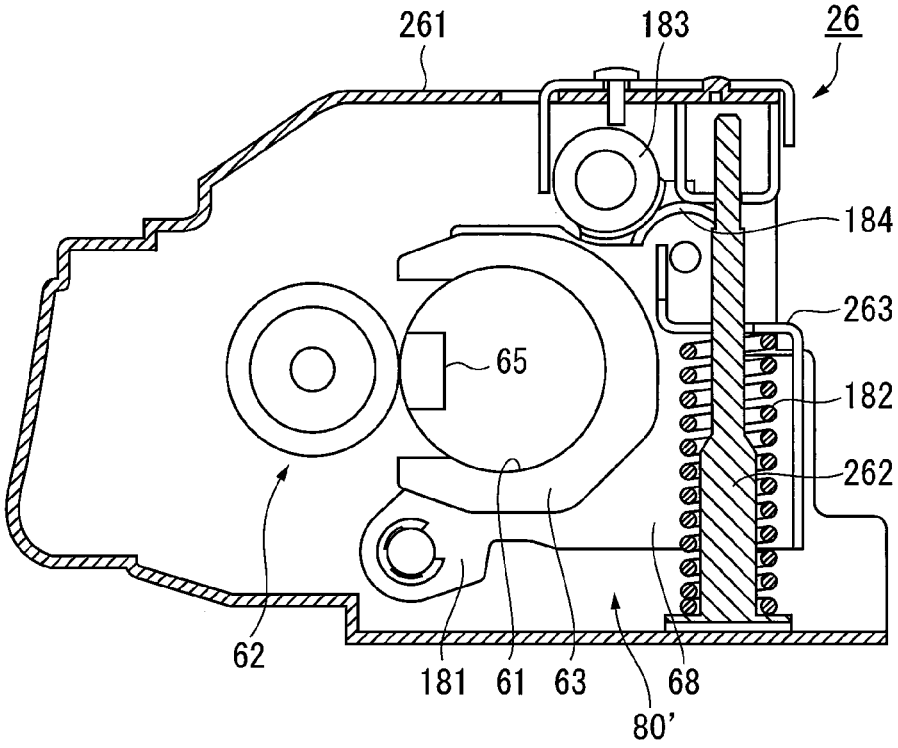
FIG. 9 shows the relevant part of a fixing device according to a first comparison example.

FIG. 9 shows the relevant part of the fixing device 26 according to the first comparison example.

In FIG. 9, the basic structure of the fixing device 26 is substantially the same as that according to the first exemplary embodiment, except that the fixing device 26 includes a pair of moving mechanisms 80', which are different from the moving mechanism according to the first exemplary embodiment. The driving-force application point (corresponding to a mesh position Q' described below) by a driving mechanism 90' is also different from the driving-force application point according to the first exemplary embodiment.

In FIG. 9, the pressure-fixing roller 62 is provided at a predetermined position in a fixed manner.

In this example, the pair of moving mechanisms 80' are provided on the heat-fixing belt 61 side.

In the moving mechanisms 80', support arms 181 project from the holders 68 for the heat-fixing belt 61 and are supported so as to be pivotable relative to the fixing housing 261. Furthermore, the retention pins 262 are fixed to portions of the fixing housing 261, and nip springs 182 are positioned with respect to the retention pins 262. First ends of the nip springs 182 are engaged with the base ends of the retention pins 262, and second ends of the compressed nip springs 182 are engaged with the hook portions 682 formed on the holders 68. With this structure, the support arms 181 are urged in the counterclockwise direction in FIG. 9 about pivot supports of the support arms 181 by the elastic restoring force of the nip springs 182.

Furthermore, in the moving mechanisms 80', cam members 183, which are eccentric rotary members, are provided in an area on the sheet-output side of the holders 68 in the fixing housing 261, and cam followers 184, which are, for example, rollers, are provided on portions of the holders 68 facing the cam members 183.

Figure 10A:
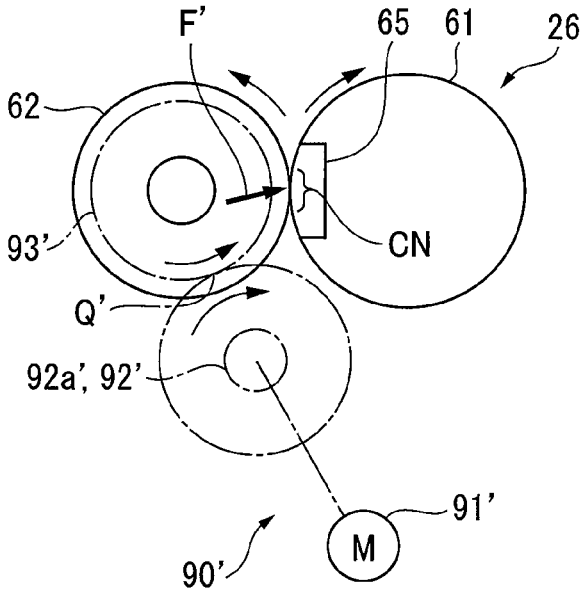
FIG. 10A shows an example of a driving mechanism of the fixing device according to the first comparison example.

As shown in FIG. 10A, in the driving mechanism 90', the driving force of a driving motor 91' is transmitted to a driven transmission gear 93' of the pressure-fixing roller 62 via a drive transmission mechanism 92'. The mesh position Q' between the drive transmission gear 92*a'*, which is located at the final stage of the drive transmission mechanism 92', and the driven transmission gear 93' is set at a position upstream of the contact area CN between the heat-fixing belt 61 and the pressure-fixing roller 62 in the rotation direction of the pressure-fixing roller 62 and at a position where the driving-force transmission direction is oriented toward the contact area CN between the heat-fixing belt 61 and the pressure-fixing roller 62.

In this example, when the distance between the circumferential surfaces of the cam members 183 and the cam followers 184 is a predetermined small distance, the holders 68 are pivoted about the support arms 181 by the urging force of the nip springs 182, bringing the heat-fixing belt 61 to the contact position where the heat-fixing belt 61 is in contact with the pressure-fixing roller 62. Meanwhile, when the distance between the circumferential surfaces of the cam members 183 and the cam followers 184 is a predetermined large distance, the cam members 183 cause the holders 68 to pivot in the clockwise direction while further compressing the nip springs 182, bringing the heat-fixing belt 61 to the retracted position where the heat-fixing belt 61 is retracted from the pressure-fixing roller 62.

However, in this example, because the distance by which the heat-fixing belt 61 is moved toward and away from the pressure-fixing roller 62 by the cam mechanism (the cam members 183 and the cam followers 184) is small, it is difficult to stably move the heat-fixing belt 61 toward and away from the pressure-fixing roller 62.

Increasing the moving distance of the heat-fixing belt 61 will increase the nip load produced by the nip springs 182, which not only makes it difficult to reduce the torque when the pressure-fixing roller 62 is driven, but also makes it difficult to suppress impacts, caused by the movement, on the heat-fixing belt 61 having a large number of attachments.

Figure 10B:
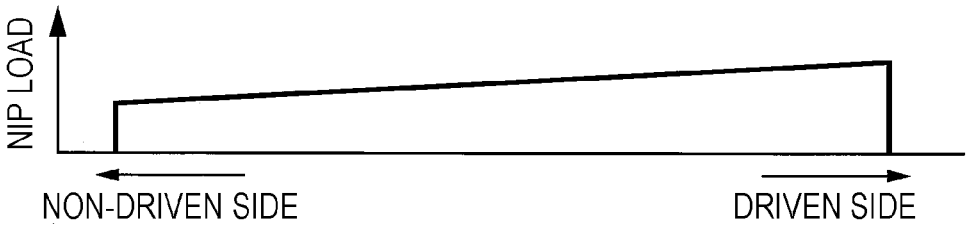
FIG. 10B shows an example of the nip pressure distribution in the longitudinal direction in a contact area in the fixing device.

Furthermore, in this comparison example, the reaction force F' caused by the application of driving force by the driving mechanism 90' acts on the contact area CN between the heat-fixing belt 61 and the pressure-fixing roller 62. Hence, in this example, the reaction force F' acts on the driving mechanism 90' side, in addition to the nip load applied to the contact area CN by the nip springs 182, which makes the nip load in the contact area CN unbalanced between the driven side and the non-driven side of the pressure-fixing roller 62, as shown in FIG. 10B.

Second Comparison Example

Figure 11:
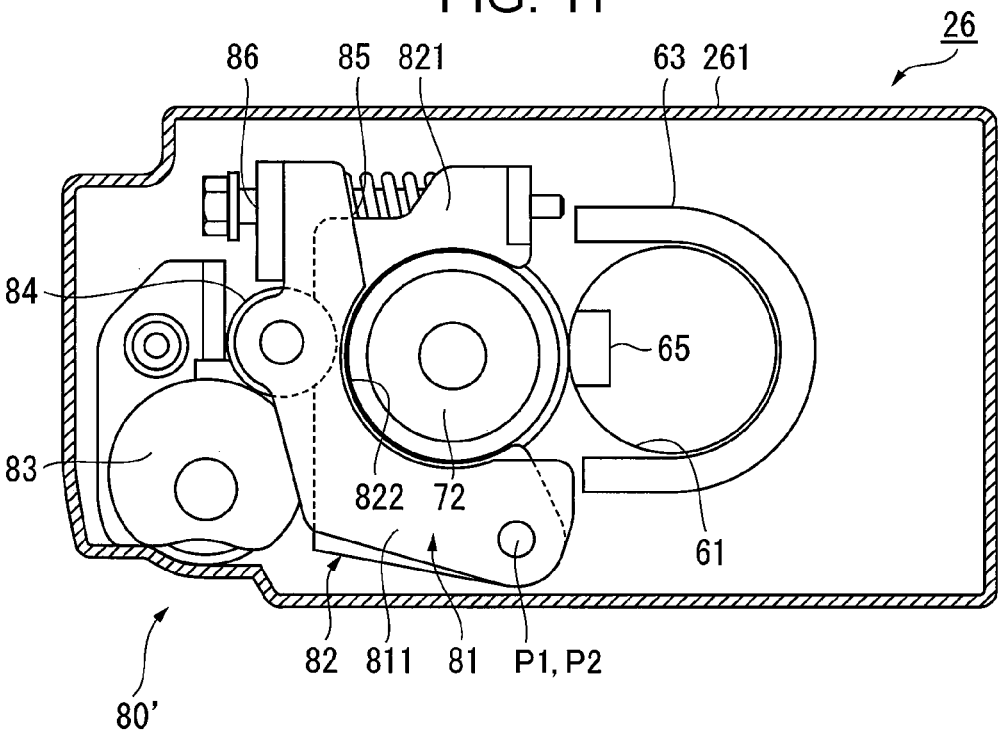
FIG. 11 shows the relevant part of a fixing device according to a second comparison example.

FIG. 11 shows the relevant part of the fixing device 26 according to a second comparison example.

The basic structure of the fixing device 26 in FIG. 11 is substantially the same as that according to the first exemplary embodiment, except that the fixing device 26 includes the moving mechanisms 80' that are different from the moving mechanism in the first exemplary embodiment. The driving-force application point by the driving mechanism 90' (see FIG. 10) is substantially the same as that in the first comparison example.

In this example, the heat-fixing belt 61 is provided at a predetermined position in a fixed manner.

The moving mechanisms 80' of the pressure-fixing roller 62 have substantially the same structure as the moving mechanism in, for example, the first exemplary embodiment.

In this comparison example, the heat-fixing belt 61 is provided in a fixed manner. Because the nip load at the contact area CN between the heat-fixing belt 61 and the pressure-fixing roller 62 is determined by the urging force of the nip spring 85, if a large moving distance is to be obtained with the moving mechanisms 80', the nip load produced by the nip spring 85 is to be increased, making it difficult to reduce the torque when the pressure-fixing roller 62 is driven.

Also in this comparison example, the reaction force F' caused by the application of driving force by the driving mechanism 90' acts on the contact area CN between the heat-fixing belt 61 and the pressure-fixing roller 62. Hence, in this example, the reaction force F' acts on the driving mechanism 90' side, in addition to the nip load applied to the contact area CN by the nip springs 85, which makes the nip load in the contact area CN unbalanced between the driven side and the non-driven side of the pressure-fixing roller 62, as shown in FIG. 10B.

Second Exemplary Embodiment

Figure 12:
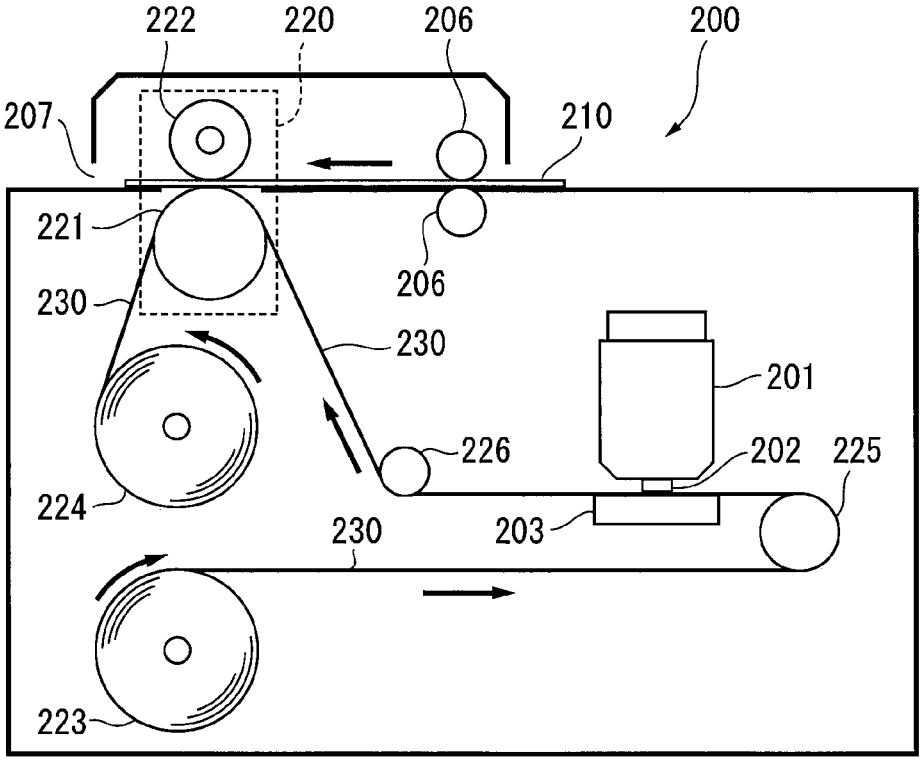
FIG. 12 shows an example of an ink jet apparatus, serving as the pressure processing device according to a second exemplary embodiment.

FIG. 12 shows the relevant part of an ink jet printer, serving as a pressure processing device according to a second exemplary embodiment.

In FIG. 12, an ink jet printer 200 includes an ink cartridge 201 that stores printing ink, a printhead 202 having ink jet nozzles on the lower surface thereof, and a platen 203 facing the printhead 202. The ink cartridge 201 and the platen 203 constitute a printing unit. FIG. 12 also shows a pair of transport rollers 206 that transport a transfer material 210 and a discharge port 207 from which the transfer material 210 after thermal transfer is discharged.

A heat press device 220, serving as a pressure device, includes a platen roller 222 and a hot roller 221 for transferring ink on hot-stamp foil to the transfer material 210, together with a foil layer.

Hot-stamp foil 230 is wound on a roller 223. The hot-stamp foil 230 paid out of the roller 223 is transported between the printhead 202 and the platen 203, where a pattern is printed with ink. The hot-stamp foil 230 on which the pattern has been printed is guided to the heat press device 220, where the ink and the foil layer are transferred to the transfer material 210 by means of heat pressing. After the transfer, the hot-stamp foil 230 is wound on a roller 224. Guide rollers 225 and 226 guide the hot-stamp foil 230.

Although the ink jet printer 200 further includes an ink carrier that reciprocates with the ink cartridge 201 held thereon, a driving mechanism for driving the ink carrier, and the like, the illustration thereof is omitted in this example.

When the thermal transfer is to be performed using this ink jet printer 200, a lateral inversion pattern of a desired pattern to be printed on the transfer material 210 is formed by using a control unit (not shown). Then, the data of the pattern is transmitted to the ink jet printer 200. The ink jet printer 200 prints the lateral inversion pattern on the hot-stamp foil 230 with the ink ejected from the printhead 202 according to the pattern. The hot-stamp foil 230 on which the pattern has been printed with ink is fed between the hot roller 221 and the platen roller 222 of the heat press device 220. Meanwhile, a transfer material 210 is transported to the heat press device 220 by the transport roller 206 and is superimposed on the hot-stamp foil 230. Heat pressing by the hot roller 221 and the platen roller 222 is performed on the superimposed portion. As a result, the ink printed on the hot-stamp foil 230 is softened and adhered to the transfer material 210, and the foil layer of the hot-stamp foil 230 is transferred to the transfer material 210, together with the ink. After the thermal transfer, the transfer material 210 is discharged from the discharge port 207, and the hot-stamp foil 230 without the foil layer is wound on the roller 224.

In this example, the first pressure element 2 and the second pressure element 3 of the present disclosure may be used as the hot roller 221 and the platen roller 222 of the heat press device 220.

Although the transfer material 210 is fed to the heat press device 220 by the transport roller 206 in this example, the transfer material 210 may be set in the heat press device 220 by hand each time transfer is to be performed. The platen roller 222 may be vertically movable to adjust the distance between the hot roller 221 and the platen roller 222, so that transfer materials 210 of various thicknesses can be used. Furthermore, although the hot-stamp foil 230 wound on the roller 223 is preliminarily stored in the ink jet printer 200 in this example, the hot-stamp foil 230 may be supplied from the outside of the ink jet printer 200.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A pressure device comprising:

a first pressure element;

a second pressure element that is disposed so as to oppose the first pressure element and that applies pressure to a medium nipped between the first pressure element and the second pressure element;

a moving device that moves the second pressure element toward and away from the first pressure element, between a contact position and a retracted position;

an urging member that urges the first pressure element toward the second pressure element when the second pressure element is located at the contact position; and a driving device that applies a driving force to the second pressure element, thus allowing the first pressure element to rotate in a driven manner when the second pressure element is located at the contact position, wherein the moving device has a moving element that is provided on a side of the second pressure element opposite from a contact area between the first pressure element and the second pressure element and that moves the second pressure element toward the first pressure element, the driving device applies the driving force in a direction in which the second pressure element is urged toward the moving element, the urging member applies an elastic urging force produced by compressive deformation to the first pressure element, and the first pressure element can be retracted by a distance smaller than a distance by which the second pressure element is moved toward and away from the first pressure element.

2. The pressure device according to claim 1, wherein the first pressure element is heated by a heating source.

3. The pressure device according to claim 2, wherein the first pressure element includes an endless belt member, the heating source, and an opposing member, the endless belt member being heated by the heating source, and the opposing member being provided on a back of the belt member opposed to the second pressure element.

4. The pressure device according to claim 1, wherein the moving element of the moving device includes a pivot member that is pivotable about a pivot support and that acts on a supported portion of the second pressure element to move the second pressure element toward and away from the first pressure element, and a displacement member that displaces the pivot member so as to pivot within a predetermined area.

5. The pressure device according to claim 2, wherein the moving element of the moving device includes a pivot member that is pivotable about a pivot support and that acts on a supported portion of the second pressure element to move the second pressure element toward and away from the first pressure element, and a displacement member that displaces the pivot member so as to pivot within a predetermined area.

6. The pressure device according to claim 3, wherein the moving element of the moving device includes a pivot member that is pivotable about a pivot support and that acts on a supported portion of the second pressure element to move the second pressure element toward and away from the first pressure element, and a displacement member that displaces the pivot member so as to pivot within a predetermined area.

7. The pressure device according to claim 4, wherein the displacement member is an eccentric rotation member.

8. The pressure device according to claim 7, wherein the pivot member has a cam follower at a portion thereof in contact with the eccentric rotation member.

9. The pressure device according to claim 1, wherein a point at which the driving device applies the driving force to the second pressure element is located upstream of a support point at which the second pressure element is supported by the moving element of the moving device in a rotation direction of the second pressure element and downstream of the contact area between the first pressure element and the second pressure element in the rotation direction of the second pressure element.

10. The pressure device according to claim 9, wherein the driving device has a drive transmission system that applies, at the point where the driving device applies the driving force to the second pressure element, the driving force in a direction in which the second pressure element moves away from the contact area.

11. The pressure device according to claim 10, wherein the moving element of the moving device includes a pivot member that is pivotable about a pivot support and that acts on a supported portion of the second pressure element to move the second pressure element toward and away from the first pressure element, and the pivot support of the pivot member is provided so as to be coaxial with a drive support of the driving device.

12. A pressure processing device comprising:

a processing unit that applies a pressure-receiving object on a medium; and the pressure device according to claim 1 that applies pressure to the pressure-receiving object on the medium.

13. A pressure device comprising:

a first pressure element;

a second pressure element that is disposed so as to oppose the first pressure element and that applies pressure to a medium nipped between the first pressure element and the second pressure element;

a moving device that moves the second pressure element toward and away from the first pressure element, between a contact position and a retracted position;

an urging member that urges the first pressure element toward the second pressure element when the second pressure element is located at the contact position; and a driving device that applies a driving force to the second pressure element, thus allowing the first pressure element to rotate in a driven manner when the second pressure element is located at the contact position, wherein the moving device has a moving element that is provided on a side of the second pressure element opposite from a contact area between the first pressure element and the second pressure element and that moves the second pressure element toward the first pressure element, the driving device applies the driving force in a direction in which the second pressure element is urged toward the moving element, and the moving element of the moving device includes a pivot member that is pivotable about a pivot support and that acts on a supported portion of the second pressure element to move the second pressure element toward and away from the first pressure element, and a displacement member that displaces the pivot member so as to pivot within a predetermined area.

14. The pressure device according to of claim 13, wherein the urging member applies an elastic urging force produced by compressive deformation to the first pressure element.

15. A pressure processing device comprising:

a processing unit that applies a pressure-receiving object on a medium; and the pressure device according to claim 13 that applies pressure to the pressure-receiving object on the medium.

16. A pressure device comprising:

a first pressure element;

a second pressure element that is disposed so as to oppose the first pressure element and that applies pressure to a medium nipped between the first pressure element and the second pressure element;

a moving device that moves the second pressure element toward and away from the first pressure element, between a contact position and a retracted position;

an urging member that urges the first pressure element toward the second pressure element when the second pressure element is located at the contact position; and a driving device that applies a driving force to the second pressure element, thus allowing the first pressure element to rotate in a driven manner when the second pressure element is located at the contact position, wherein the moving device has a moving element that is provided on a side of the second pressure element opposite from a contact area between the first pressure element and the second pressure element and that moves the second pressure element toward the first pressure element, the driving device applies the driving force in a direction in which the second pressure element is urged toward the moving element, and a point at which the driving device applies the driving force to the second pressure element is located upstream of a support point at which the second pressure element is supported by the moving element of the moving device in a rotation direction of the second pressure element and downstream of the contact area between the first pressure element and the second pressure element in the rotation direction of the second pressure element.

17. The pressure device according to of claim 16, wherein the urging member applies an elastic urging force produced by compressive deformation to the first pressure element.

18. The pressure device according to claim 16, wherein the driving device has a drive transmission system that applies, at the point where the driving device applies the driving force to the second pressure element, the driving force in a direction in which the second pressure element moves away from the contact area.

19. The pressure device according to claim 18, wherein the moving element of the moving device includes a pivot member that is pivotable about a pivot support and that acts on a supported portion of the second pressure element to move the second pressure element toward and away from the first pressure element, and the pivot support of the pivot member is provided so as to be coaxial with a drive support of the driving device.

20. A pressure processing device comprising:

a processing unit that applies a pressure-receiving object on a medium; and the pressure device according to claim 16 that applies pressure to the pressure-receiving object on the medium.

* * * * *